US006722224B2

(12) United States Patent
Nordstrom

(10) Patent No.: US 6,722,224 B2
(45) Date of Patent: Apr. 20, 2004

(54) DUAL AXIS JOYSTICK FOR OPERATING HYDRAULIC VALVES

(75) Inventor: Robert Scott Nordstrom, Wauwatosa, WI (US)

(73) Assignee: Husco International, Inc., Waukesha, WI (US)

( * ) Notice: Subject to any disclaimer, the term of this patent is extended or adjusted under 35 U.S.C. 154(b) by 0 days.

(21) Appl. No.: 10/043,011

(22) Filed: Jan. 7, 2002

(65) Prior Publication Data

US 2003/0126938 A1 Jul. 10, 2003

(51) Int. Cl.[7] ..... G05G 9/00
(52) U.S. Cl. ..... 74/471 XY
(58) Field of Search ..... 74/471 XY, 473.33; 137/636.2; 200/64; 273/148 B

(56) References Cited

U.S. PATENT DOCUMENTS

| | | | | |
|---|---|---|---|---|
| 3,388,609 A | | 6/1968 | Miller | |
| 3,541,877 A | | 11/1970 | Houk | |
| 3,741,031 A | | 6/1973 | Schwerdtfeger | |
| 3,831,633 A | | 8/1974 | Comer | |
| 4,027,547 A | | 6/1977 | Rahman et al. | |
| 4,028,958 A | * | 6/1977 | Schuermann et al. | 74/471 XY |
| 4,523,488 A | | 6/1985 | Ahrendt | |
| 4,572,019 A | | 2/1986 | Suzuki | |
| 4,938,091 A | | 7/1990 | Waggoner et al. | |
| 5,140,865 A | | 8/1992 | Foster | |
| 5,232,057 A | | 8/1993 | Renard | |
| 5,287,743 A | * | 2/1994 | Doolittle et al. | 74/471 XY |
| 5,288,198 A | | 2/1994 | Mozingo | |
| 5,360,312 A | | 11/1994 | Mozingo | |
| 5,480,276 A | | 1/1996 | Mozingo | |
| 5,497,847 A | * | 3/1996 | Ota et al. | 180/333 |

* cited by examiner

*Primary Examiner*—Jack Lavinder
*Assistant Examiner*—Xuan Lan Nguyen
(74) *Attorney, Agent, or Firm*—George E. Haas; Quarles & Brady LLP

(57) ABSTRACT

A joystick for manually operating a pair of hydraulic valve members has a bracket to which a handle is attached. A pivot shaft rotationally extends between a pair of legs of the bracket and has a transverse aperture through which a pivot pin attaches the pivot shaft to a base of the joystick. This attachment structure allows the bracket to pivot with respect to the base about two orthogonal axes. A first link for coupling to one hydraulic valve member is pivotally attached to the pivot shaft, while a second link for coupling to another hydraulic valve member is attached by a ball joint to the bracket.

21 Claims, 1 Drawing Sheet

DUAL AXIS JOYSTICK FOR OPERATING HYDRAULIC VALVES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to manual controls for operating hydraulic valves on machinery, and in particular to a "joystick" type control device that operates hydraulic valves that control two functions of a machine.

2. Description of the Related Art

Construction and agricultural equipment have working members which are driven by hydraulic actuators, such as cylinder and piston assemblies, for example. Each cylinder is divided into two internal chambers by the piston and selective application of hydraulic fluid under pressure to either of the chambers produces movement of the piston in a corresponding direction.

Application of hydraulic fluid to the cylinder chambers often is controlled by a spool type valve, such as the one described in U.S. Pat. No. 5,579,642. In this type of hydraulic valve, a manually operable control device is mechanically connected to a control spool which slides within a bore in a valve body. Movement of the spool into various positions controls flow of fluid through two separate paths in the valve. For example in one position pressurized hydraulic fluid is directed along one path from a pump to one of the cylinder chambers and other hydraulic fluid drains through a different path from the other cylinder chamber to a tank. By varying the size of orifices in each path, the rate of fluid flow into the cylinder chambers can be varied, thereby moving the piston at proportionally different speeds.

One type of control device for manually operating hydraulic valves, commonly referred to as a "joystick", can be pivoted about two orthogonal axes to operate a valve assembly which controls actuators for two functions of a machine. For example, movement about one axis may swing a boom left or right, while movement about the other axis raises or lowers the boom. The joystick is normally biased into a centered position at which the hydraulic valve assembly is in the closed state and actuator movement does not occur. In one common configuration, two valve spools are connected to the joystick, one valve spool for each axis of movement. Considering movement along one axis, when a handle of the joystick is pivoted in one direction from center, one valve spool is operated to produce movement of a first actuator in one direction (e.g. to move the boom leftward). Pivoting the joystick handle in the opposite one direction from center operates the valve spool to move the first actuator in another direction (e.g. to move the boom rightward). Similar bidirectional control of a second actuator occurs when the joystick handle is moved in either direction from center about the second axis to operate the other valve spool. The valve spools or components of the control device are biased by springs which cause the control device to return to the neutral center position upon being released by the operator.

The joystick must convert the pivotal movement about an axis into linear motion that can slide the spool or other type of valve member in a hydraulic valve. Such movement conversion should be smooth. Furthermore, the relationship between pivoting the handle and movement of the valve spool should be linear throughout the entire range of motion,

SUMMARY OF THE INVENTION

A control device manually operates two hydraulic valve members which control flow of hydraulic fluid to different functions on a machine. The control device includes a base for attachment to a support. A bracket has a main section from which a first leg and a second leg project, preferably orthogonally from the plane of the main section. A pivot shaft rotationally extends between the first and second legs so that the bracket is able to pivot about a first axis with respect to the pivot shaft. A pivot pin couples the pivot shaft to the base in a manner that enables pivotal movement between the base and the pivot shaft (and the bracket) about a second axis that is orthogonal to the first axis.

A first link is pivotally coupled to the pivot shaft for attachment to one of the hydraulic valve members. A second link is pivotally coupled to the bracket for attachment to the other hydraulic valve member.

Pivoting the bracket about the first axis produces linear movement of the first link and thus operates one of the hydraulic valve members. Pivoting the bracket about the second axis produces linear movement of the second link and thus operates the other hydraulic valve member. The bracket can be pivoted about only one of the axes at a time to operate only one of the valve member and the corresponding machine functions. At other times, the bracket can be pivoted simultaneously about both axes to operate both hydraulic valve members and both of the associated machine functions.

DETAILED DESCRIPTION OF THE INVENTION

Figure 1:
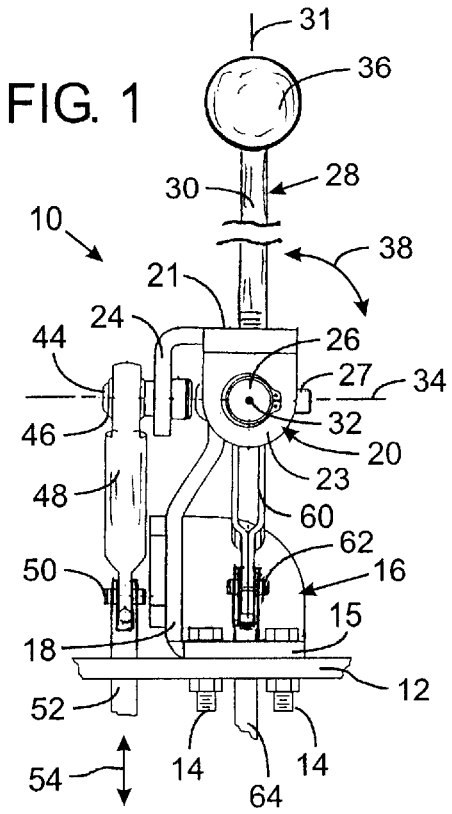
FIG. 1 is a front elevational view of a joystick according to the present invention.
Figure 2:
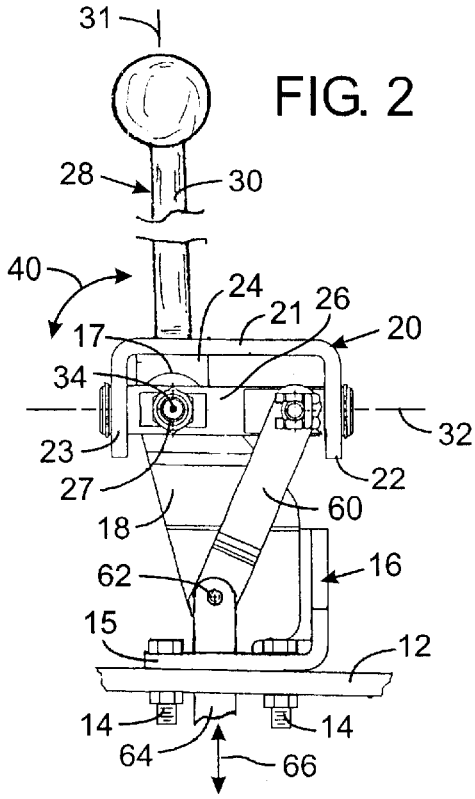
FIG. 2 is a side elevational view of the joystick.

With initial reference to FIGS. 1 and 2, a manually operable control device, such as a joystick 10, is mounted on a member 12 of a machine. Specifically a pair of bolts 14 extend through a base plate 15 to secure a base 16 of the joystick 10 to the machine member 12. The base 16 has an upright portion 18 which projects away from the base plate 15 and has a remote end 17 with an aperture there through.

Figure 3:
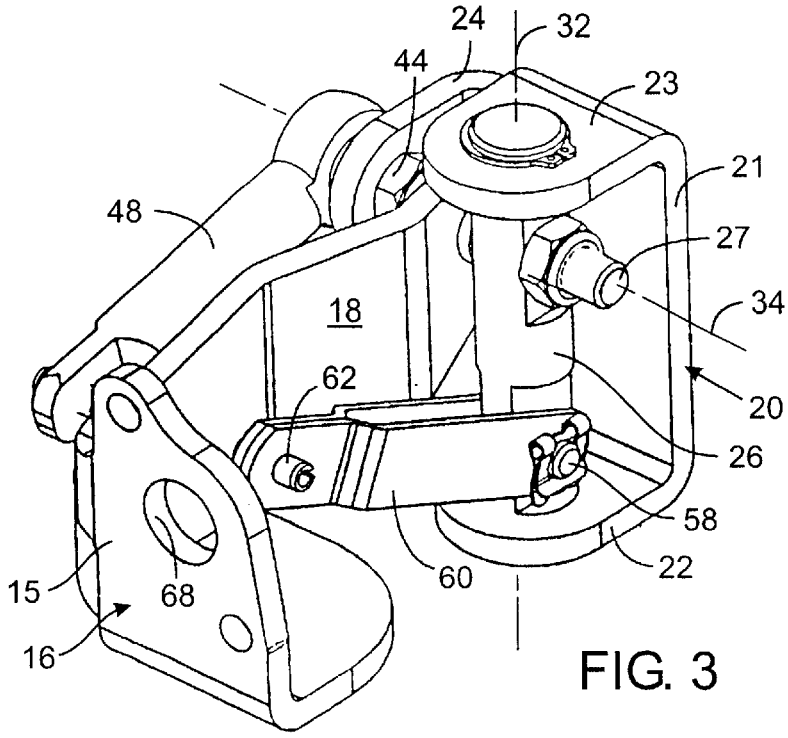
FIG. 3 is an isometric view of the mechanical linkage for the joystick that is tilted on its rear side.

With additional reference to FIG. 3, the joystick 10 also includes a bracket 20 which has a main section 21, formed by a flat plate, with first and second legs 22 and 23 projecting from two opposite sides of the main section. A third leg 24 projects from another side of the main section 21 that extends between the two opposite sides 22 and 23. The three legs 22–24 project at right angles from the plane of the main section 21 of the bracket toward the base plate 15. Each leg 22–24 has an aperture there through.

The pivot shaft 26 extends between the opposing first and second legs 22 and 23 of a bracket 20 and is received in the apertures of those legs in a manner that allows the bracket to rotate about the first axis 32 of the pivot shaft. A pivot pin 27 projects through the aperture in the upright section 17 of the base 16 and through an aperture in a pivot shaft 26. The pivot pin 27 allows rotational movement between the base 16 and the pivot shaft 26 about a second axis 34. The first and second axes 32 and 34 intersect orthogonally at a point between the first and second legs 22 and 23.

A handle 28 is attached to the bracket 20. For example, the handle 28 is formed by a lever 30, such as a rod with a threaded end that is received in an aperture in the bracket's main section 21. The longitudinal axis 31 of the handle lever 30 intersects the intersection of the first and second axes 32 and 34. The handle 28 also has a knob 36 attached to the remote end of the lever 30 to facilitate gripping by a user. Manipulation of the handle 28 by a user as indicated by arrows 38 in FIG. 1 causes the bracket 20 to pivot about the first axis 32 shown in FIG. 1. The handle 28 also may be manipulated in an orthogonal direction as indicated by arrows 40 in FIG. 2 causing the bracket 20 to pivot about the second axis 34. Thus, the bracket 20 is able to be pivoted independently about one of both of the orthogonal first and second axes 32 and 34 of the joystick 10.

The third leg 24 of the bracket 20 has an aperture there through which is aligned with the second axis 34 of the pivot pin 27. A first link pin 44 has one end that extends through the aperture in the third leg 24 and has a remote section with a spherical surface. That remote section of the first link pin 44 is received within a spherical socket in a first link 48 to form a ball joint 46 coupling the link shaft to the link pin. That ball joint coupling allows multiple degrees of freedom of movement between the first link pin 44 and the first link 48. The remote end of the shaft-like first link 48 is connected by a roll pin 50 to a first hydraulic valve member 52, such as a spool of a hydraulic valve.

Another aperture extends through the pivot shaft 26 spaced from and parallel to the aperture through which the pivot pin 27 is received. With reference to FIGS. 2 and 3, a second link pin 58 passes through this other aperture and pivotally connects one end of a second link 60 thereto. The remote end of the second link 60 has a second roll pin 62 mounted thereon which engages a second hydraulic valve member 64, such as another spool, which projects through a hole 68 in the base plate 15 (see FIG. 3). Linear movement of the second hydraulic valve member 64 opens and closes a fluid path through the hydraulic valve. The two hydraulic valve members 52 and 64, operated by the first and second links 48 and 60, may be received in different bores of a common valve body, e.g. a monoblock, or of separate valve bodies.

In use an operator of the machine is able to pivot the combination of the joystick handle 28 and bracket 20 about only one of the first and second axes 32 and 34 or simultaneously about both those axes. As the bracket 20 pivots about the first axis 32 as indicated by arrows 38 in FIG. 1, the third leg 24 of the bracket moves up or down depending on the direction of the pivoting. This action causes the first link 48 to similarly move up or down due to the coupling to the third leg 24 provided by the first link pin 44. This in turn produces an upward or downward movement of the first hydraulic valve member 52. The ball joint 46 at the interface between the first link pin 44 and the first link 48 allows swivel motion between those components so that the movement of the first link pin 44 in an arc is translated into linear movement of the first hydraulic valve member 52 as indicated by arrows 54.

If the bracket 20 pivots only about the first axis 32, the pivot shaft 26 shown in FIG. 2 does not move. As a consequence, the second link 60 and second hydraulic valve member 64 do not move.

Correspondingly, when the bracket 20 pivots about the second axis 34 as indicated by arrows 40 in FIG. 2, the pivot shaft 26 also rotates about that axis so that the end engaging the second link pin 58 moves up or down. That action causes the second link 60 that also engages the second link pin 58 to move up or down, which in turn produces upward or downward movement of the second hydraulic valve member 64. It should be understood that the pivot shaft 26 does not rotate about the first axis 32, but only pivots about the second axis 34. Thus the second link 60 is able to translate the up or down motion in an arc at the end coupled to the second link pin 58 into linear motion at the opposite end which acts on the second hydraulic valve member 64 producing linear movement.

When the bracket 20 pivots only about the second axis 34, the third leg merely rotates about the second axis and does not move about the first axis 32 as evident from FIG. 1. Because the first link pin 44 is centered on the second axis 34, such rotation thereabout does not produce movement of the first link 48 and thus does not operate the first hydraulic valve.

One should also understand that simultaneous movement of the combination of the joystick handle 28 and bracket 20 about both the first and second axes 32 and 34 produces simultaneous motion of both hydraulic valve members 52 and 64.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. For example, the present invention has been described in the context of operating spool type valves, however one will appreciate that the joystick can be used to operate other types of valves. Accordingly, the scope of the invention should be determined from the following claims and not limited by the above disclosure.

What is claimed is:

1. A control device for operating two linear operators of a hydraulic valve assembly, said control device comprising:

a base;

a bracket having a main section from which a first leg and a second leg extend;

a pivot shaft rotationally extending between the first and second legs of the bracket, wherein the bracket is able to pivot with respect to the pivot shaft about a first axis;

a pivot pin engaging and contacting the pivot shaft and the base thereby enabling pivotal movement between the pivot shaft and the base about a second axis that is orthogonal to the first axis;

a first link coupled to the pivot shaft for attachment to one of the two linear operators; and a second link coupled to the bracket for attachment to another of the two linear operators.

2. The control device as recited in claim 1 further comprising a handle coupled to the bracket.

3. The control device as recited in claim 2 wherein the handle has a longitudinal axis that passes through an intersection of the first axis and the second axis.

4. The control device as recited in claim 2 wherein the handle is attached to the bracket at a point that is on a line which passes through the first axis and the second axis.

5. The control device as recited in claim 1 wherein the bracket further comprises a third leg extending from the main section, and the first link being pivotally connected to the third leg.

6. The control device as recited in claim 5 further comprising a ball joint coupling the first link to the third leg of the bracket.

7. The control device as recited in claim 1 further comprising a ball joint coupling the first link to the bracket.

8. The control device as recited in claim 1 further comprising a link pin coupling the first link to the pivot shaft.

9. A joystick for operating a first hydraulic valve member and a second hydraulic valve member, said joystick comprising:

a base having a first aperture;

a bracket having a main section with a first side, a second side and a third side extending between the first side and the second side, the bracket including a first leg projecting from the first side and having a second aperture therein, a second leg projecting from the second side and having a third aperture therein, and a third leg projecting from the third side;

a lever connected to the bracket;

a pivot shaft received in the second and third apertures of the bracket, wherein the bracket is able to pivot with respect to the pivot shaft about a first axis, the pivot shaft having a fourth aperture there through;

a pivot pin received in the first aperture of the base and in the fourth aperture of the pivot shaft, thereby enabling pivotal movement between the pivot shaft and the base about a second axis that is orthogonal to the first axis;

a first link for attachment to the first hydraulic valve member and pivotally coupled to the third leg of the bracket pivot shaft; and a second link for attachment to the second hydraulic valve member and pivotally coupled to the pivot shaft.

10. The joystick as recited in claim 9 wherein the lever has a longitudinal axis that passes through an intersection of the first axis and the second axis.

11. The joystick as recited in claim 9 wherein the first leg, the second leg and the third leg project orthogonally to a surface of the main section of the bracket.

12. The joystick as recited in claim 9 further comprising a first link pin coupling the first link to the third leg of the bracket.

13. The joystick as recited in claim 12 wherein the first link pin is coupled to the first link by a ball joint.

14. The joystick as recited in claim 9 further comprising a ball joint coupling the first link to the bracket.

15. The joystick as recited in claim 9 further comprising fifth aperture in the pivot shaft; and a link pin extending through the fifth aperture and engaging the second link.

16. The joystick as recited in claim 9 wherein the first link includes a first mechanism for pivotally coupling to the first hydraulic valve member; and the second link includes a second mechanism for pivotally coupling to the second hydraulic valve member.

17. A joystick for manually operating a first hydraulic valve member and a second hydraulic valve member, said joystick comprising:

a base having a first aperture;

a bracket having a main section with a first side, a second side and a third side extending between the first side and the second side, the bracket having a first leg projecting from the first side with a second aperture through the first leg, a second leg projecting from the second side with a third aperture through the second leg, and a third leg extending from the third side with a fourth aperture through the third leg;

a lever attached to the bracket;

a pivot shaft received in the second and third apertures in the bracket, wherein the bracket is able to pivot with respect to the pivot shaft about a first axis, the pivot shaft having a fifth aperture and a sixth aperture there through;

a pivot pin received in the first aperture in the base and the fifth aperture in the pivot shaft, thereby enabling pivotal movement between the pivot shaft and the base about a second axis that is orthogonal to the first axis;

a first link for attachment to the first hydraulic valve member;

a first link pin received in the fourth aperture in the third leg and having a section with a spherical surface which is received in the socket of the first link;

a second link for attachment to the second hydraulic valve member and having a socket therein; and second link pin received in the sixth aperture of the pivot shaft and engaging the second link to provide a pivotal connection there between.

18. The joystick as recited in claim 17 wherein the lever has an axis that orthogonally intersects the first axis and the second axis.

19. The joystick as recited in claim 17 wherein the main section of the bracket has a major surface from which the lever extends, and the first leg, the second leg and the third leg are orthogonal to the major surface.

20. The joystick as recited in claim 17 wherein the first link includes a first mechanism for pivotally coupling to the first hydraulic valve member; and the second link includes a second mechanism for pivotally coupling to the second hydraulic valve member.

21. The control device as recited in claim 1 wherein the first link engages the pivot shaft; and the second link engages the bracket.

* * * * *

UNITED STATES PATENT AND TRADEMARK OFFICE

CERTIFICATE OF CORRECTION

PATENT NO. : 6,722,224 B2
DATED : April 20, 2004
INVENTOR(S) : Robert S. Nordstrom It is certified that error appears in the above-identified patent and that said Letters Patent is hereby corrected as shown below:

Column 5,
Line 35, delete "pivot shaft".

Signed and Sealed this

Twentieth Day of July, 2004

JON W. DUDAS
*Acting Director of the United States Patent and Trademark Office*